United States Patent [19]

Albertin et al.

[11] 4,071,058

[45] Jan. 31, 1978

[54] PUMPING UNIT FOR TELEVISION TUBES

[75] Inventors: Michel Albertin, Annecy; Louis Maurice, Paris, both of France

[73] Assignee: Compagnie Industrielle des Telecommunications Clt-Alcatel S.A., Paris, France

[21] Appl. No.: 680,567

[22] Filed: Apr. 27, 1976

[30] Foreign Application Priority Data

May 5, 1975 France ..... 75 13953

[51] Int. Cl.[2] ..... B65B 31/04

[52] U.S. Cl. ..... 141/65; 417/85

[58] Field of Search ..... 141/8, 65, 1-12, 141/37-68

[56] References Cited

U.S. PATENT DOCUMENTS 2,757,840 8/1956 Weissenberg et al. ..... 141/65

*Primary Examiner*—Houston S. Bell

*Attorney, Agent, or Firm*—Sughrue, Rothwell, Mion, Zinn and Macpeak

[57] ABSTRACT

A two stage pumping unit for evacuating tubes, and in particular television tubes. A primary mechanical pump is air-cooled and is connected in series with an oil diffusion pump. The inlet for the stem of a tube to be evacuated has a sealing ring and between the sealing ring and the diffusion pump there is a baffle. Between the two pumps there is an oil condensation device and an oil trap. The trap, the condensation device, the oil diffusion pump, the baffle and the sealing ring are arranged for cooling by forced air.

6 Claims, 3 Drawing Figures

PUMPING UNIT FOR TELEVISION TUBES

BACKGROUND OF THE INVENTION

1. Field of the Invention

The present invention relates to a pumping unit for evacuating tubes and in particular television tubes. To obtain a hard vacuum in the order of $10^{-7}$ torr in a television tube, a two-stage pumping device is generally used comprising a first stage with a mechanical vacuum pump and a second stage with an oil vapour flux diffusion vacuum pump.

2. Description of the Prior Art

It is known for the evacuating of television tubes to be effected by arranging the tubes on frames installed on castors; the frames are driven by a chain through a tunnel furnace in which the vacuum degassing of the tubes is effected by heating them to a temperature in the order of 400° C. Only the top part of the frame carrying the tube is brought into the furnace.

During the vacuum degassing operation, means must be provided for preventing simultaneous ingress of oil molecules passing from the secondary pump into the tube in which a vacuum is being generated. For this purpose, the diffusion pump body and a baffle placed above the pump on its inlet side are vigorously cooled by a flow of pumped water. The water pump must be powerful enough to keep the walls of the diffusion pump at a sufficiently low temperature for substantially all the oil to be condensed at the level of the walls. This requires a fairly heavy device which consumes a great quantity of water and has a surprisingly high consumption of electricity. Moreover, the water supplied to the device causes progressive obstruction and scaling of its supply pipes.

The present invention provides a two stage pumping unit for evacuating tubes, comprising a frame supporting an air-cooled mechanical vacuum pump as a first stage connected in series with an oil diffusion pump as a second stage by a discharge pipe, the diffusion pump having an inlet for receiving the stem of a tube to be evacuated, a seal surrounding the inlet and an oil vapour baffle disposed between the inlet and a body of the pump, the body being enclosed in a main housing, the discharge pipe which connects the pumps in series having a rising portion above the outlet of the oil diffusion pump, and the unit having forced draft generator means drawing air from a relatively cool region of the frame and connected to force a cooling draft into the main housing of the diffusion pump, over the rising portion of the discharge pipe, over the baffle and over the seal surrounding the inlet.

It will be seen that preferred embodiments of this pump have various advantages over existing pumps. The consumption of water, as well as the civil engineering expenses required by the construction of the input and output pipes, are avoided.

Moreover, the scaling and blocking up of the water pipes are also avoided.

Since each pumping frame is provided with its own two-stage pumping device and its own fans for providing a forced air draft, possible breakdowns are limited to individual frames and need not cause the stopping of all of the pumping frames, as occurs in water-cooled frames, in which a breakdown of the water supply in any one of the frames stops all the frames.

Lastly, the consumption of electricity used for cooling the installation is reduced substantially by half.

BRIEF DESCRIPTION OF THE DRAWINGS

An embodiment of the invention will be described by way of an example with reference to the accompanying drawings in which.

DETAILED DESCRIPTION OF THE PRIOR ART

Figure 1A:
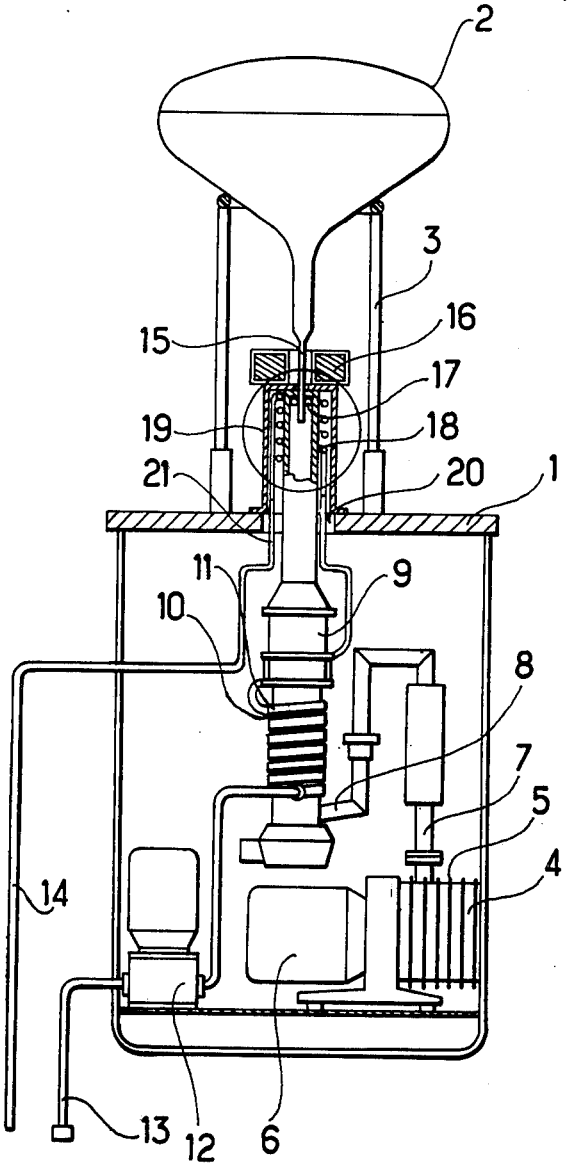
FIG. 1a (PRIOR ART)
FIG. 1*a* is a partially cutaway side view of a prior art pumping assembly.
Figure 1B:
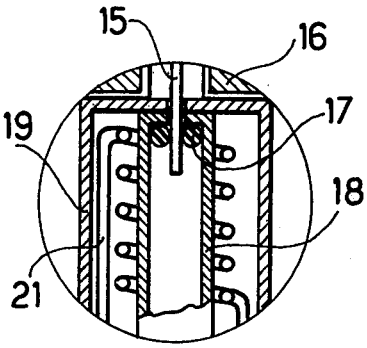
FIG. 1b (PRIOR ART)
FIG. 1*b* is an enlargement of a part of FIG. 1*a;*.

With reference to FIGS. 1*a* and 1*b*, a pumping frame supports a television tube 2 held in place by uprights 3. Inside the pumping frame a primary mechanical rotary vacuum pump 4 is provided with an independent air cooling system 5. The rotary pump 4 is driven by a drive motor 6. A suction port 7 of the primary pump 4 is connected to the discharge port 8 of a secondary oil diffusion vacuum pump 9. The secondary pump 9 has a body 10 which is surrounded by a cooling coil 11 supplied with water by a water pumping unit 12. The water is supplied through an input pipe 13, and heated water is removed through an output pipe 14. A resistance-furnace 16 is disposed round a stem 15 of the television tube 2 to enable the stem 15 to be sealed when pumping is completed, while maintaining a vacuum in the tube 2. A sealing ring 17 is disposed for convenience' sake between the pumping system and the tube 2 in the vicinity of the resistane-furnace 16. All this part of the frame is inserted in the furnace at 400° C.

To prevent excessive heating of the seal 17, the top part of the suction pipe 18 of the secondary pump 9 is surrounded by a housing 19 communicating with the interior of the pumping frame through an opening 20, thereby extending the cooled region to surround the seal 17. Furthermore a water pipe 21 extends into the housing 19 specifically to cool the seal 17.

As well as the excessive energy consumption noted above of conventional pumping frames, another disadvantage is that when the tube 2 is ready, it is removed from the frame, and even if the precaution of stopping the primary pump 4 has previously been taken, air still rushes into the secondary pump 9 and some of the oil vapour escapes into the pipe connecting the secondary pump 9 to the primary pump 4. The result of this is a loss of oil in the secondary pump 9. This oil is expensive, resulting in unnecessary expenditure for the manufacturer. This phenomenon is observed also in the case of an implosion of the tube. It therefore seemed desirable, in an improved device, also to remove this disadvantage of television tube pumping frames.

DESCRIPTION OF THE PREFERRED EMBODIMENT

Figure 2:
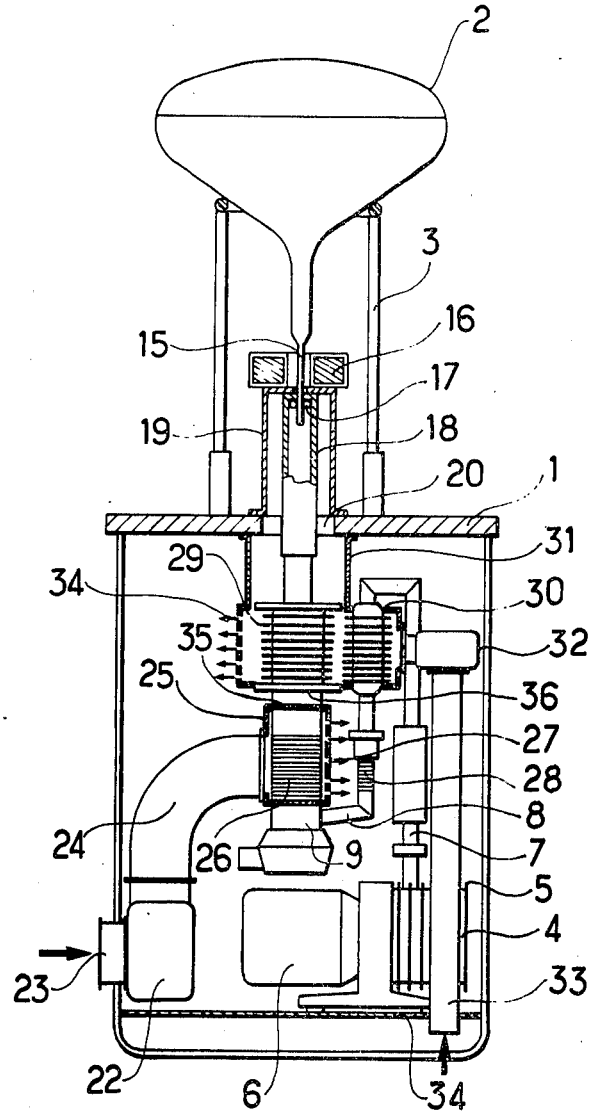
FIG. 2 is a side view, similar to FIG. 1*a* of a pumping assembly embodying the present invention.

In FIG. 2, which shows an embodiment of the pumping unit according to the present invention, the same reference numerals, as in FIGS. 1*a* and 1*b*, have been used for elements in the installation which are the same in both pumping units described. Therefore, the unchanged presence of the television tube 2 supported by the uprights 3, will be observed on the frame 1. Likewise, the primary vacuum pump 4 remains unchanged, equipped with its drive motor 6 and with its independent air-cooling system 5. Similarly, the furnace 16 comes into action at the right moment to close the stem 15. The different elements of this embodiment are the use of a fan 22 whose inlet 23 is disposed near the base of the pumping frame. (It may advantageously be relocated at any cooler point if there is one in the immediate vicinity of the frame 1). The air sucked in through the inlet 23 is conveyed by a pipe 24 directly into a housing 25 surrounding the body 10 of the diffusion pump 9. The body 10 is provided with splines 26, which differ, both in their operation and in their use, from the fins conventionally arranged round elements which are to be cooled by air. Cooling fins are advantageous when the air with which they are in contact moves slowly or when it is required to exchange heat with the outside medium by radiation; but when a gaseous cooling fluid is flowing at a high speed, better heat exchange is achieved by using splines which improve convection. On the opposite side to its cool air intake, the housing 25 is drilled with openings 27 in order to enable the cooling by convection around splines 28 traced on the L-shaped discharge pipe of the secondary pump 9. On cooling that part of the discharge pipe, any oil vapour of the secondary pump which may have escaped from the secondary pump 9 is condensed and collected. The cooling can also serve to condense any oil molecules which may escape from the primary pump when the desired vacuum is reached.

A known baffle 29 is placed above the body of the suction pump 9. The baffle 29 has parallel metallic blades (not shown) inside the suction tube of the secondary pump 9 and made of a material which is a very good heat conductor, such as aluminium. The blades are inclined with respect to the vertical, their number and their width being such that they intercept, in a known way, any rectilinear trajectory of residual oil molecules escaping from the secondary pump 9.

These blades are thermally and mechanically connected to a support which is itself made of a heat-conducting material. The support is cooled by air by means of fins (as illustrated) or of splines.

The pipe connecting the primary vacuum pump 4 to the secondary vacuum pump 9 comprises, at the same height as the baffle 29 above its splines 28, a trap 30, generally formed, like the baffle 29, of parallel metallic blades inclined in relation to the vertical.

The trap 30 and the baffle 29 are placed in a secondary housing 31 concentric to both the sealing ring 17 and the suction pipe 18. A fan 32 draws cold air from under the pumping frame (or from any other colder point if there is one in the vicinity of the frame 7), by means of a vertical pipe 33. After having cooled the trap 30, the baffle 29, the suction pipe 18 and the seal 17, the air is driven out through outlets 34. The arrangement of the outlets is calculated in such a way that the air, which circulates in the upper housing 19, is permanently under slight over-pressure.

If the air flow, generated by the fan 32, is great, the circulation of air round the trap 30 and round the baffle 29 is rapid (turbulent flow) and the trap 30 and the baffle 29 should be provided with splines, as is the pump body 26. Alternatively if this air flow is not large, sufficient cooling of the baffle 29 and of the trap 30 can be provided within the baffle 29 and within the trap 30 by fitting them with fins cooled by a laminar air flow. This arrangement is shown in FIG. 2. The appropriate air flow rate and consequent use of splines or fins is a design choice. The secondary housing 31 is connected in a fluid-tight manner through opening 20 to the upper housing 19. The upper housing 19 is made of an insulating and reflecting material to protect the seal 17 which ensures the eventual sealing of the vacuum in the television tube 2 on the pumping unit. The cold air entering the upper housing 19 through the opening 20 will generate a slight overpressure of air, preventing the ingress of hot air from the furnace. The suction pipe 18 is made of a metal which is a good heat conductor and it contributes to the cooling of the upper seal 17.

It will therefore be seen that preferred embodiments of the present invention ensure numerous advantages:

Reduction of the electric power used for cooling the frame;

Elimination of the risks of general breakdowns due to the blocking up or sealing of the water supply pipes;

No need to provide the water installation;

Recuperation of the oil of the secondary pump dissipated at each change of tube or in the case of implosion of the latter.

The present invention has been described with reference to its use in pumping frames for television tubes. A like cooling device and pumping frame can be implemented in any other installation for degassing in a vacuum.

Although the device which has just been described may appear to be most advantageous in application to the generating of a vacuum in television tubes, it will be readily understood that modifications can be made without going beyond the scope of the invention. In particular the various elements described can be replaced by others fulfilling the same technical functions.

What is claimed is:

1. In a two stage pumping unit for evacuating tubes terminating in a stem, said unit comprising a frame, an air-cooled mechanical vacuum pump supported by said frame, an oil diffusion pump, a discharge pipe connecting said mechanical vacuum pump and said oil diffusion pump in series with said mechanical vacuum pump acting as a first stage pump and said oil diffusion pump acting as a second stage pump, a suction pipe connected to said diffusion pump and having an inlet for receiving the stem of said tube to be evacuated, said oil diffusion pump including a pump body, a seal surrounding the inlet and an oil vapor baffle carried by said suction pipe and disposed between the inlet and the pump body, a main housing for enclosing said diffusion pump body, said discharge pipe having a portion extending parallel to and to the side of said oil diffusion pump, the improvement comprising: said unit having forced draft generator means for drawing air from a relatively cool region of said frame, and forcing a cooling draft through said first housing across said parallel portion of said discharge pipe extending parallel to said oil vapor baffle, and across said baffle and said suction pipe in the vicinity of the seal surrounding the inlet.

2. A pumping unit according to claim 1, further including a trap within said portion of said discharge pipe extending parallel to said suction pipe and adjacent said oil vapor baffle, and wherein said trap is in the path of cooling draft air which passes across said oil vapor baffle.

3. A pumping unit according to claim 1, further comprising a second housing for enclosing said trap, said baffle, said suction pipe from said baffle to said upper seal and wherein said forced draft generator means forces air through said second housing.

4. A pumping unit according to claim 3, wherein said forced draft generator means comprises first and second forced draft generators, said second housing is connected to the first forced draft generator and includes outlets such as to maintain a slight overpressure in said second housing during operation of said first forced draft generator.

5. A pumping unit according to claim 4, wherein the second forced draft generator is connected to the first housing.

6. A pumping unit according to claim 1, wherein said first housing has a set of air outlets facing a portion of the discharge pipe which extends parallel to said diffusion pump suction pipe such that cooling air is forced under operation to cool that portion of the discharge pipe.

* * * * *